US005611657A

United States Patent [19]

Peterson

[11] Patent Number: 5,611,657

[45] Date of Patent: Mar. 18, 1997

[54] REINFORCED LOADER ARM ASSEMBLY

[75] Inventor: Robert T. Peterson, Gladstone, Ill.

[73] Assignee: Case Corporation, Racine, Wis.

[21] Appl. No.: 402,902

[22] Filed: Mar. 13, 1995

[51] Int. Cl.[6] ..... B21D 11/00

[52] U.S. Cl. ..... 414/722; 414/686

[58] Field of Search ..... 414/686, 722, 414/694, 685; 228/165, 174

[56] References Cited

U.S. PATENT DOCUMENTS

| | | | |
|---|---|---|---|
| 1,452,238 | 4/1923 | Finnigan | 228/165 |
| 1,804,837 | 5/1931 | Lunn | 228/165 |
| 1,884,295 | 10/1932 | Schwennker | 228/165 |
| 2,604,569 | 7/1952 | Denneen | 228/174 |
| 3,022,911 | 2/1962 | Granryd . | |
| 4,156,488 | 5/1979 | Stark . | |
| 4,193,734 | 3/1980 | Williams | 414/727 |
| 4,260,322 | 4/1981 | Cameron . | |
| 4,428,173 | 1/1984 | Knell | 414/722 |
| 4,737,067 | 4/1988 | Samejima et al. | 414/686 |
| 4,988,033 | 1/1991 | Hesse | 228/165 |
| 5,015,148 | 5/1991 | Johnson et al. | 414/722 |
| 5,111,578 | 5/1992 | Ball et al. | 414/722 |
| 5,282,566 | 2/1994 | Lammers et al. | 414/722 |

*Primary Examiner*—Karen B. Merritt
*Assistant Examiner*—Gregory A. Morse
*Attorney, Agent, or Firm*—Foley & Lardner

[57] ABSTRACT

A loader arm assembly is configured to rotate about an axis defined by a pivot pin. The loader arm assembly includes a loader arm having a first end and a second end, the first end having a cavity. The cavity is configured to be aligned with an axis of rotation. The cavity has a cavity perimeter. The loader arm assembly further includes a pivot tube assembly including a pivot tube having an inner bore configured to engage a pivot pin for rotation about the axis. The pivot tube further has an outer perimeter. A portion of the outer perimeter fixedly engages the cavity perimeter. The pivot tube assembly further includes one or more plates extending from the pivot tube in fixed parallel engagement with the loader arm.

18 Claims, 4 Drawing Sheets

REINFORCED LOADER ARM ASSEMBLY

FIELD OF THE INVENTION

The present invention generally relates to an assembly configured for rotation about an axis. The present invention more particularly relates to a loader arm assembly for use with vehicles such as loaders, backhoes and the like.

BACKGROUND OF THE INVENTION

A loader vehicle generally includes a wheeled tractor or other engine-driven vehicle. A bucket is attached to one end by two arms. The arms lift and rotate the bucket under power and control from the tractor. In its lowest position, the bucket may be maintained substantially level with the ground for scraping, digging and dozing dirt, gravel, grain or other material. In its highest position, the bucket is several feet off the ground. Rotation of the bucket allows the bucket to roll back, to prevent spillage of contents during transport and to roll forward for dumping. The vehicle includes a hydraulic system for raising, lowering and rotating the bucket. An operator in a cab controls the operation of the loader. A backhoe-loader vehicle includes a bucket at one end and a backhoe at the other end.

The combination of bucket and arms is known as a boom. The two arms are attached to the vehicle chassis at one end and to the bucket at the other end. The connection to the chassis is known as the upper pivot point. At the upper pivot point, the arms rotate about an axis defined by the points of attachment between the arms and the chassis. Hydraulic cylinders are connected between the arm and chassis. Operation of the hydraulic cylinders rotates the arms about the axis, raising and lowering the boom.

The bucket is also attached to the arms by a rotating connection. The bucket rotates about an axis defined by the points of attachment between the bucket and the arms. A hydraulic linkage controls rotation of the bucket. The hydraulic linkages which move the arms and the bucket are under control of the operator.

Normal use of the boom for loader operation puts extreme mechanical stress on the entire boom assembly. Scraping and lifting operations in particular put both compressive and torsional stress on the boom. The upper pivot points, where the arms attach to the vehicle chassis, are particularly affected by torsional stress.

The forces generated by operation of the loader may be sufficient to structurally damage the loader at the upper pivot points. Damage may occur to one or both of the arms of the boom or to the chassis at the point where the arms attach.

Accordingly, there is a need for a reinforced loader arm assembly capable of withstanding the compressive and torsional stresses associated with operation of the loader.

SUMMARY OF THE INVENTION

The invention therefor provides a loader arm assembly configured to rotate about an axis defined by a pivot pin. The loader arm assembly comprises a loader arm having a first end and a second end. The first end has a cavity configured to be aligned with the axis and having a cavity perimeter. The loader arm assembly further comprises a pivot tube assembly including a pivot tube having an inner bore configured to engage the pivot pin for rotation about the axis. The pivot tube further has an outer perimeter, and a portion of the outer perimeter is fixedly engaged to the cavity perimeter. The pivot tube assembly further includes one or more plates extending from the pivot tube in fixed parallel engagement with the loader arm.

Another embodiment of the invention provides an arm assembly configured for rotation about an axis defined by a pivot pin. The assembly comprises an arm having a first end and a second end. The arm has a cavity at the first end. The assembly further comprises a pivot tube weldment including a pivot tube rigidly fixed within the cavity and one or more plates welded to the pivot tube and the arm. The pivot tube has an inner bore configured to rotatably receive the pivot pin.

DETAILED DESCRIPTION OF THE PREFERRED EMBODIMENT

Figure 1:
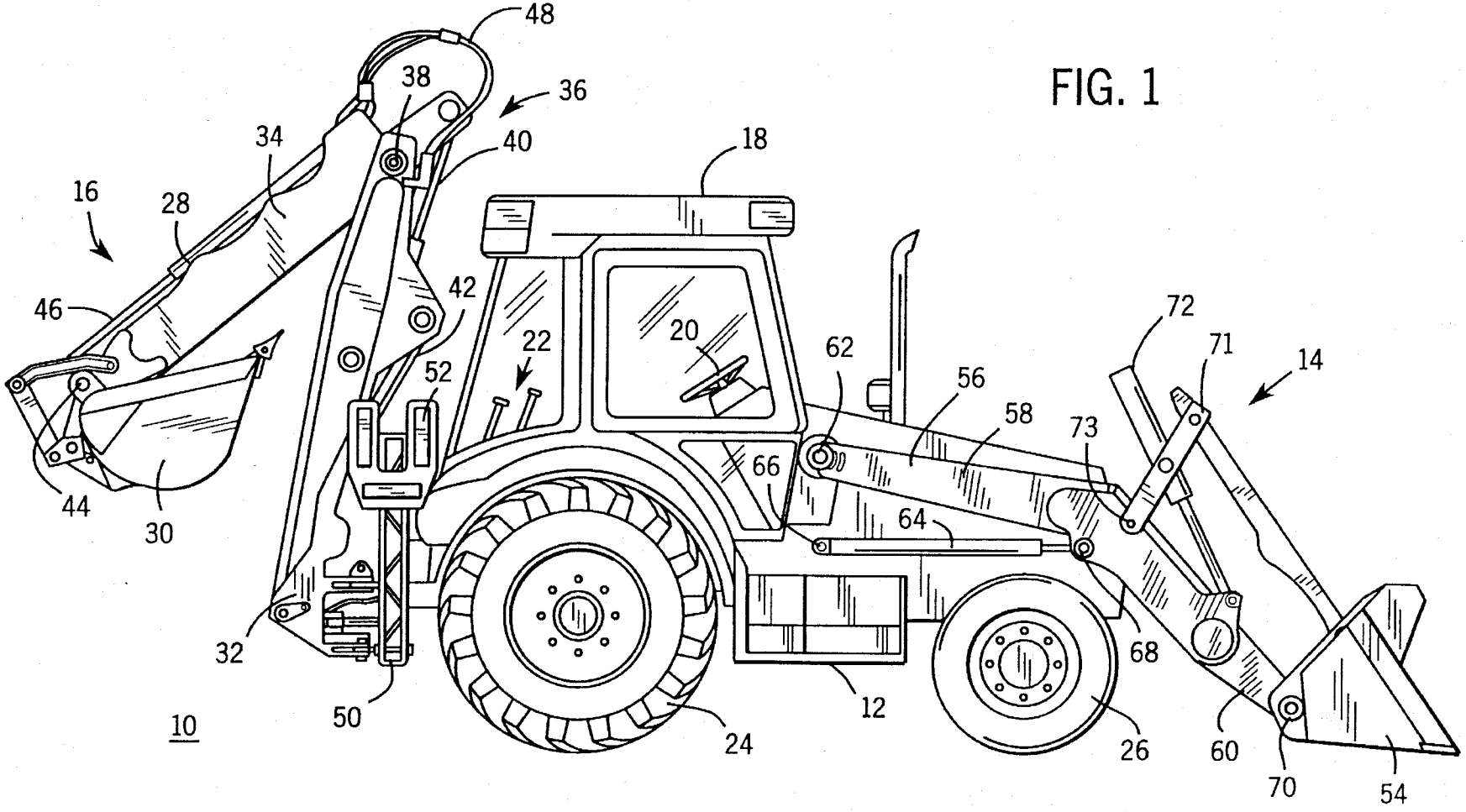
FIG. 1 is a side elevational view of a backhoe-loader vehicle.

Referring now to FIG. 1, there is shown a backhoe-loader vehicle 10. The vehicle 10 includes a tractor 12, a loader boom 14 and a backhoe 16. The tractor 12 includes a cab 18 wherein an operator may ride during operation of the vehicle 10. Within the cab 18 are controls such as a steering wheel 20 and control levers 22 for controlling operation of the hydraulics of vehicle 10. The tractor 12 further includes drive wheels 24 and steerable wheels 26. The drive wheels 24 are driven by an engine (not shown) within the tractor. The engine generally provides power to power mechanical, hydraulic and electrical systems of the vehicle 10. The steerable wheels 26 turn in response to action of the steering wheel 20 to steer the vehicle 10 as the vehicle traverses the ground.

The backhoe 16 includes a backhoe arm 28 and a backhoe bucket 30. The backhoe arm further includes a boom 32 and a lower arm or dipper 34. The boom 32 and the dipper 34 are joined at a joint 36. The joint 36 includes a pivot pin 38. The dipper 34 rotates about the pivot pin 38. A dipper hydraulic linkage 40 rotates the lower arm or dipper 34 in relation to boom 32. A boom hydraulic linkage 42 rotates the boom 32 in relation to the tractor 12.

The bucket 30 is rotatably attached to the lower arm or dipper 34. The bucket 30 rotates about a bucket pivot pin 44. A bucket hydraulic linkage 46 rotates the bucket 30 about the bucket pivot pin 44 in relation to the lower arm 34. The dipper hydraulic linkage 40, the boom hydraulic linkage 42 and the bucket hydraulic linkage 46 are part of the hydraulic system (not shown) of the vehicle 10. The backhoe arm 28 includes bucket hydraulic lines 48 for supplying hydraulic fluid to the bucket hydraulic linkage 46. Similar hydraulic lines (not shown) supply hydraulic fluid to the dipper hydraulic linkage 40 and the boom hydraulic linkage 42.

The vehicle 10 also includes a pair of stabilizers 50 (one on each side of tractor 10). The stabilizers 50 include stabilizer pads 52. During operation of the backhoe, stabilizers 50 may be lowered, bringing the stabilizer pads 52 into the contact with the ground or other work surface, stabilizing the vehicle 10.

The loader boom 14 includes a bucket 54 and a loader arm assembly 56. The boom further includes a second loader arm assembly (not shown) mounted in a similar position on the opposite side of the tractor 12. The loader arm assembly 56 includes an upper arm 58 and a lower arm 60. The upper arm 58 and the lower arm 60 do not pivot in relation to one another, and are preferably rigidly fixed together.

The loader arm assembly 56 is pivotable at a first end about a pivot pin 62. The boom 14 further includes a loader arm hydraulic linkage 64. The hydraulic linkage 64 has a first end pivotally attached to a point 66 on the chassis of the tractor 12 and second end pivotally attached to a point 68 on the loader arm assembly 56. Activation of the loader arm hydraulic linkage 64 causes the loader arm assembly 62 to pivot about the pivot pin 62, raising and lowering the boom 14.

The bucket 54 is pivotally attached to the loader arm assembly 56. The bucket 54 rotates about a pivot pin 70, at a second end of the loader arm assembly 56. The boom 14 further includes a rotation linkage 71 and a bucket hydraulic linkage 72 for rotating the bucket 54 about the pivot pin 70. The rotation linkage 71 is attached to the loader arm assembly 56 at a point 73.

Figure 3:
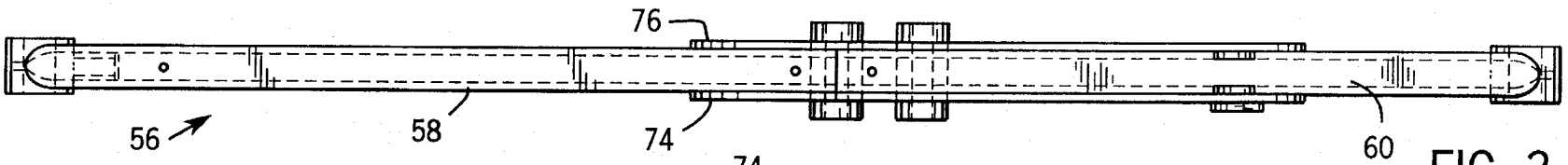
FIG. 3 is a top view of the loader arm assembly of FIG. 2.
Figure 2:
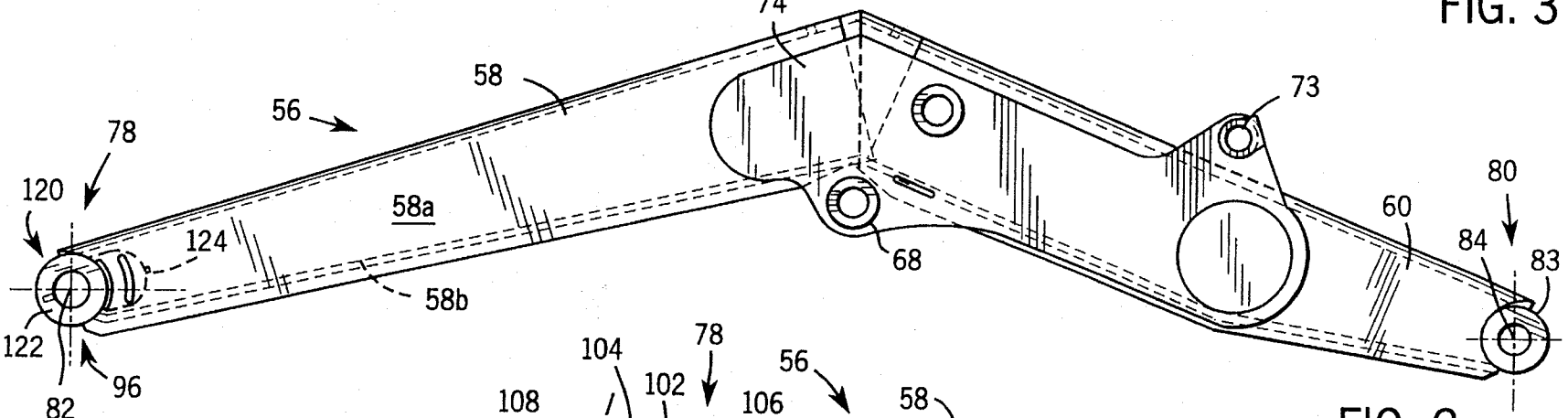
FIG. 2 is a side elevational view of a loader arm assembly for use with the backhoe-loader vehicle of FIG. 1.

Referring now to FIGS. 2 and 3. Loader arm assembly 56 includes upper arm 58 and lower arm 60. The loader arm assembly 56 further includes reinforcing plates 74, 76 which reinforce the junction between the upper arm 58 and the lower arm 60. In addition, the reinforcing plates 74, 76 form the point 68 where the loader arm hydraulic linkage 64 pivotally attaches to the loader arm assembly 56. Still further, the reinforcing plates 74, 76 form the point 73 where the rotation linkage 71 attaches to the loader arm assembly 56. Preferably, the upper arm 58, the lower arm 60 and reinforcing plates 74, 76 are welded together.

The loader arm assembly 56 includes a first end 78 and a second end 80. The first end 78 is configured to be pivotally mounted to the chassis tractor 12 for rotation about the pivot pin 62 (FIG. 1). The loader arm assembly 56 rotates about an axis 82 defined by the pivot pin.

The second end 80 of the loader arm assembly 56 is configured for attachment to the bucket 54 (FIG. 1). A pivot tube 83 at the second end of the loader arm assembly 56 is configured to receive the pivot pin 70. The pivot pin 70 (FIG. 1) defines an axis of rotation 84. The bucket 54 rotates about the axis 84. The pivot tube 83 is preferably welded to the end of the loader arm assembly 56.

Figure 4:
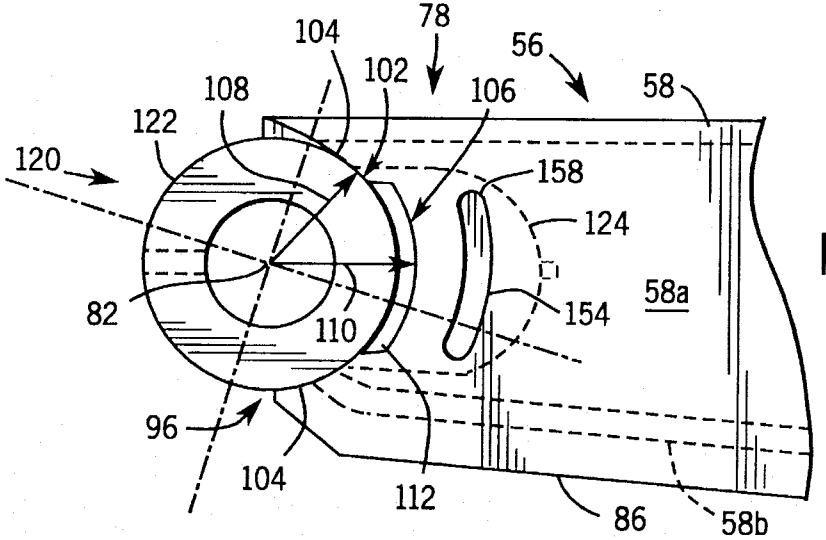
FIG. 4 is a detailed side elevational view of a portion of the loader arm assembly of FIG. 2.
Figure 5:
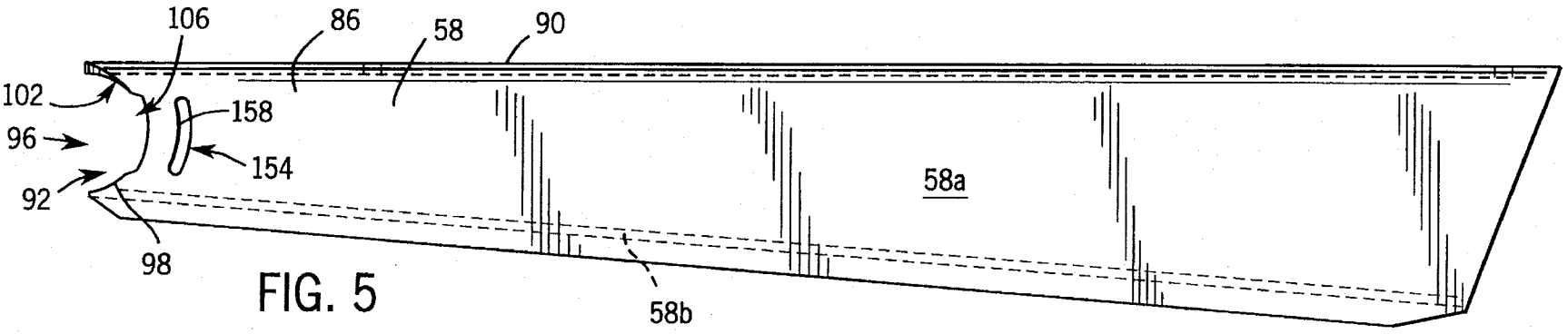
FIG. 5 is a side elevational view of an upper loader arm for use with the loader arm assembly of FIG. 2.
Figure 6:
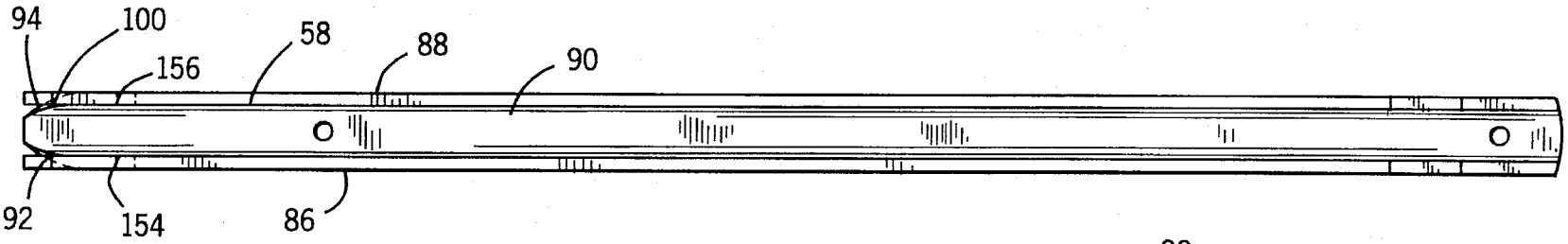
FIG. 6 is a top view of the upper loader arm of FIG. 5.
Figure 7:
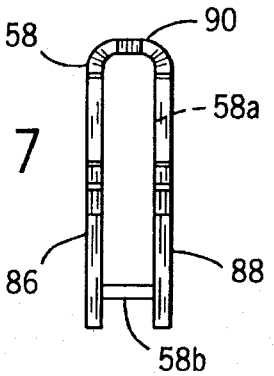
FIG. 7 is an end view of the upper loader arm of FIG. 5.

Referring to FIGS. 4–7, there is shown an upper arm 58 for use in conjunction with the loader arm assembly 56 illustrated in FIGS. 2 and 3. As can be seen in FIGS. 5–7, the upper arm 58 is preferably fabricated from a U-shaped piece of metal 58*a* such as steel having a bottom portion 58*b*. Arm 58 is preferably formed to the shape illustrated in FIGS. 4–7. After forming, the upper arm 58 includes a first side portion or wall 86 and a second side portion or wall 88. The first and second side walls 86, 88 are joined by a central portion 90 and portion 58*b* welded between walls 86 and 88 at the bottom thereof (FIG. 4). The first and second portions 86, 88 are preferably substantially parallel.

The first side portion 86 includes a first void 92. The second side wall 88 includes a second void 94. Together, the first void 92 and the second void 94 form a cavity 96 at the first end 78 of the loader arm assembly 56. The first void 92 has a first inner perimeter 98. The second void 94 has a second inner perimeter 100. Together, the first inner perimeter 98 and the second perimeter 100 form a cavity perimeter 102.

As is illustrated in detail in FIG. 4, the cavity perimeter 102 includes a first region 104 and a second region 106. The first region 104 is a first radial distance 108 from the axis 82 defined by the pivot pin 70 (not shown in FIG. 4). The second region 106 of the cavity perimeter 102 is a second radial distance 110 from the axis 82. Preferably, the second radial distance 110 is greater than the first radial distance 108 to form a slot 112.

Figure 9:
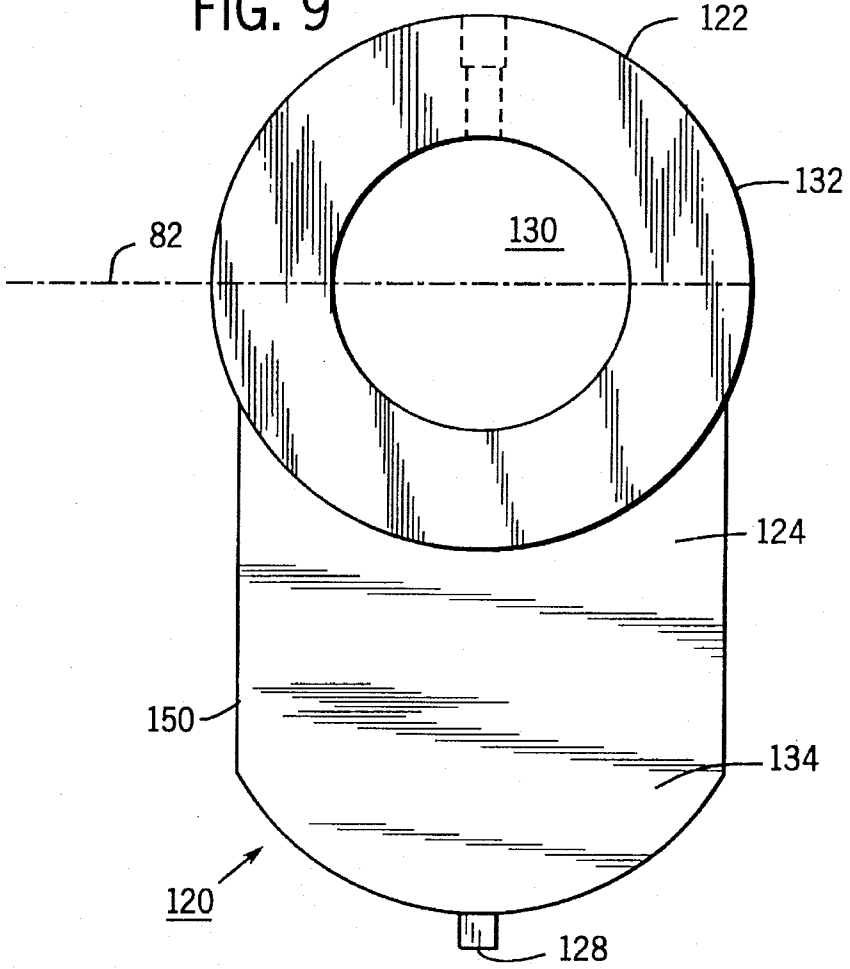
FIG. 9 is a side elevational view of the pivot tube assembly of FIG. 8.
Figure 8:
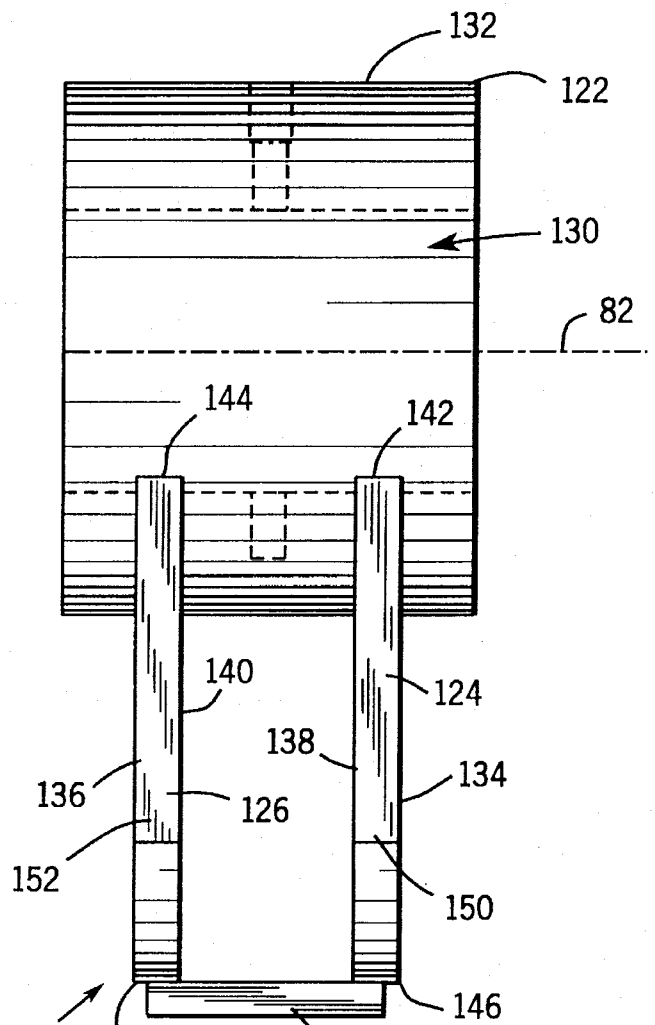
FIG. 8 is a front elevational view of a pivot tube assembly for use in conjunction with the loader arm assembly of FIG. 2.

The loader arm assembly 56 further includes a pivot tube weldment or assembly 120 as is illustrated in FIGS. 8 and 9. The pivot tube assembly 120 includes a generally annular pivot tube 122 and first and second plates 124, 126 extending from the pivot tube. The pivot tube 122 and the first and second plate 124, 126 are preferably welded together. However, the pivot tube 122 and the first and second plates 124, 126 could be fabricated in any other suitable manner, such as by casting. The pivot tube assembly 120 preferably further includes a spacer 128 to ensure proper spacing between the plates 124, 126. The pivot tube 122 includes an inner bore 130 configured to engage pivot pin 70 (not shown in FIGS. 8 and 9) for rotation about the axis 82. Alternatively, a bushing or other device may be placed within the inner bore 130 between the pivot tube and the pivot pin 70. The pivot tube 122 further includes an outer perimeter 132.

The first and second plates 124, 126 each includes an outer flat side 134, 136, respectively, and an inner flat side 138, 140 respectively. Each of the plates 124, 126 further includes a proximate end 142, 144, respectively, and a distal end 146, 148 respectively. Preferably, the proximate end 142 of the first plate 124 is welded to the outer perimeter 132 of pivot tube 122 and the proximate end 144 of the plate 126 is welded to the outer perimeter 132 of the pivot tube 122. The first plate 124 has a perimeter 150 and the second plate 126 has a perimeter 152.

As is illustrated in FIGS. 2–4, a portion of the outer perimeter 132 of the pivot tube 122 fixedly engages the cavity perimeter 102. Preferably, the first region 104 of the cavity perimeter 102 is welded to the portions of the outer perimeter 132 of the pivot tube adjacent to the cavity perimeter 104.

The slot 112, formed by the difference between the second radial distance 110 and the first radial distance 108, permits welding access to the second region 106 of the cavity perimeter 102. Therefore, during manufacturing of the loader arm assembly 56, the first plate 124 may be welded to the first side wall or portion 86 and the second plate 126 may be welded to the second side wall or portion 88 along the slot 112. Preferably, the slot 112 is at least ten millimeters in width to permit welding access. After the plates 124, 126 are welded to the side walls 86, 88, the plates 124, 126 are placed in fixed parallel engagement with the upper loader arm 58.

Referring to FIGS. 4–6, the first side wall 86 preferably includes a first perforation 154 and the second side wall 88 preferably includes a second perforation 156. As illustrated in FIGS. 4 and 5, the first and second perforations 154, 156 are preferably crescent shaped but may be any suitable shape. As is illustrated in FIG. 4, the perforation 154 has a perforation perimeter 158. The second perforation 156 has a similar perforation perimeter, not shown. Preferably, when the loader arm assembly 56 is assembled, the first plate 124 covers perforation 154. Similarly, when the loader arm assembly 56 is assembled, the second plate 126 preferably covers perforation 156. During assembly, the first perforation 154 and the second perforation 156 provide an additional welding perimeter for welding the first plate 124 and the second plate 126 to the first side wall 86 and the second side wall 88, respectively.

As can be seen from the foregoing, there is provided a loader arm assembly for use with a loader or backhoe-load vehicle and the like. The loader arm assembly includes a pivot tube assembly configured to engage a pivot pin to pivotally secure the arm assembly to a tractor. The pivot tube assembly includes one or more plates which extend from the pivot tube and are in fixed parallel engagement with the loader arm. The end of the loader arm is formed or cut to create a slot to allow an additional welding during manufacturing. The loader arm further includes perforations on both sides to allow additional welding between the loader arm and the plates of the pivot tube assembly. In this manner, the joint between the loader arm and the pivot tube assembly is reinforced to allow additional structural integrity against deformation, fatigue or damage as a result of compression or torsional forces encountered during operation of the loader.

While a particular embodiment of the present invention has been shown and described, modifications may be made. For example, the loader arm assembly could be formed from a single piece of material such as steel, rather than from an upper arm and lower arm welded together. It is therefore intended in the appended claims to cover all such changes and modifications which fall within the true spirit and scope of the invention.

What is claimed is:

1. A loader arm assembly configured to rotate about an axis defined by a pivot pin, the axis being substantially normal to the loader arm, the loader arm assembly comprising:

a loader arm having a first end and a second end, the first end having a cavity including a cavity perimeter, wherein the loader arm includes substantially parallel first and second side portions and a central portion joining the first and second side portions, the first and second side portions being substantially normal to the axis; and a pivot tube assembly including a pivot tube having an inner bore configured to engage the pivot pin for rotation about the axis, the pivot tube further having an outer perimeter, a portion of the outer perimeter fixedly engaging the cavity perimeter, the pivot tube assembly further including one or more plates extending from the pivot tube between the first and second side portions and in fixed engagement with at least one of the first and second side portions of the loader arm.

2. A loader arm assembly as defined in claim 1 wherein the one or more plates includes a first plate in fixed parallel engagement with the first side portion and a second plate in fixed parallel engagement with the second side portion.

3. A loader arm assembly as defined in claim 2 wherein a first end of the first side portion includes a first void, the first void having a first inner perimeter, and a first end of the second side portion includes a second void, the second void having a second inner perimeter, the first and second voids aligning to form the cavity, the first and second inner perimeters forming the cavity perimeter.

4. A loader arm assembly as defined in claim 3 wherein a first portion of the outer perimeter fixedly engages the first inner perimeter and a second portion of the outer perimeter fixedly engages the second inner perimeter.

5. A loader arm assembly as defined in claim 4 wherein the first portion of the outer perimeter is welded to the first inner perimeter and the second portion of the outer perimeter is welded to the second inner perimeter.

6. A loader arm assembly as defined in claim 5 wherein each respective plate includes an outer flat side and an inner flat side and a proximate end and a distal end, wherein each respective proximate end is welded to the pivot tube, and wherein each respective plate is welded to a respective side portion to maintain each respective outer flat side in parallel engagement with the respective side portion.

7. A loader arm assembly as defined in claim 6 wherein each respective proximate end is welded to the outer perimeter of the pivot tube.

8. A loader arm assembly as defined in claim 2 wherein the first plate is welded to the first side portion and the second plate is welded to the second side portion.

9. A loader arm assembly as defined in claim 8 wherein each respective plate has a respective plate perimeter, each respective side portion being welded to each respective plate along a portion of each respective plate perimeter, and wherein each respective side portion includes a perforation having a perforation perimeter, each respective side portion being welded to each respective plate along a portion of each respective perforation perimeter.

10. A loader arm assembly as defined in claim 1 wherein the cavity perimeter has a first portion a first radial distance from the axis and a second portion a second radial distance from the axis, the second radial distance being greater than the first radial distance to establish a slot between the outer perimeter of the pivot tube and the cavity perimeter.

11. A loader arm assembly as defined in claim 10 wherein the first and second side portions each has a respective side portion void, the side portion voids aligning to establish the cavity, and wherein the cavity perimeter includes a first side portion void perimeter and a second side portion void perimeter, each respective side portion perimeter establishing a respective slot between the outer perimeter of the pivot tube and the respective side portion perimeter, and wherein the one or more plates include a first plate welded to the first side portion and a second plate welded to the second side portion, each respective slot providing access for welding the respective plate to the pivot tube and the respective side portion.

12. An assembly configured for rotation about an axis defined by a pivot pin, the assembly comprising:

an arm having a first end and a second end, the arm having a cavity at the first end, wherein the arm comprises a first substantially flat side wall and a second substantially flat side wall, the second side wall being substantially parallel to the first side wall, the first and second side walls being substantially normal to the axis; and a pivot tube weldment including a pivot tube rigidly fixed within the cavity and at least one plate extending from the pivot tube between the first and second side walls, at least one plate welded to the pivot tube and at least one of the first and second side walls, the pivot tube having an inner bore configured to rotatably receive the pivot pin.

13. An assembly as defined in claim 12 wherein the cavity is substantially semicircular and sized to receive the pivot tube.

14. An assembly as defined in claim 13 wherein the pivot tube is annular with a substantially circular outer perimeter, a portion of the outer perimeter fixedly engaging the cavity.

15. An assembly as defined in claim 14 wherein the one or more plates includes a first plate welded to the pivot tube and the first side wall and a second plate welded to the pivot tube and the second side wall.

16. An assembly as defined in claim 15 wherein each respective plate includes an outer flat side and an inner flat side and a proximate end and a distal end, wherein each respective proximate end is welded to the outer perimeter of the pivot tube, and wherein each respective plate is welded to a respective side wall.

17. An assembly as defined in claim 16 wherein each side wall includes a perforation having an inner opening aligned with an outer opening, each respective plate being in surrounding relationship with a respective inner opening of a respective perforation, each respective plate being welded to each respective sidewall at said inner opening.

18. An assembly as defined in claim 14 wherein each side wall has a respective side wall void, the side wall voids aligning to establish the cavity, and wherein the first side wall includes a first side wall void perimeter and the second side wall includes a second side wall void perimeter, each respective side wall perimeter establishing a respective slot between the outer perimeter of the pivot tube and the respective side wall perimeter, and wherein the one or more plates include a first plate welded to the first side wall and a second plate welded to the second side wall, each respective slot providing access for welding the respective plate the pivot tube and the respective side wall.

* * * * *